US009340394B2

(12) United States Patent
Brügger et al.

(10) Patent No.: US 9,340,394 B2
(45) Date of Patent: May 17, 2016

(54) EQUIPMENT FOR CONNECTING PANELS OF AN ELEVATOR CAGE

(75) Inventors: Beat Brügger, Lucerne (CH); Christoph Schuler, Cham (CH); Lukas Zeder, Huddinge (SE); René Strebel, Buttwil (CH); Thomas Wuest, Hochdorf (CH); Urs Schaffhauser, Root (CH)

(73) Assignee: Inventio AG, Hergiswil (CH)

( * ) Notice: Subject to any disclaimer, the term of this patent is extended or adjusted under 35 U.S.C. 154(b) by 531 days.

(21) Appl. No.: 13/369,391

(22) Filed: Feb. 9, 2012

(65) Prior Publication Data

US 2012/0205199 A1 Aug. 16, 2012

(30) Foreign Application Priority Data

Feb. 11, 2011 (EP) ..... 11154176

(51) Int. Cl.
*B66B 11/02* (2006.01)

(52) U.S. Cl.
CPC ..... *B66B 11/0253* (2013.01); *Y10T 29/49826* (2015.01)

(58) Field of Classification Search
CPC B66B 11/0253; B66B 11/02; B66B 11/0226; F16B 21/09; F16B 5/0036; E04B 1/6116
USPC ..... 187/401; 29/428; 403/331, 353, 403/325–329, 360
See application file for complete search history.

(56) References Cited

U.S. PATENT DOCUMENTS

| | | | | | |
|---|---|---|---|---|---|
| 2,490,663 | A | * | 12/1949 | Van Uum | E04F 13/0848 24/337 |
| 2,915,151 | A | * | 12/1959 | Kekenak | 52/781 |
| 4,199,907 | A | * | 4/1980 | Bains et al. | 52/122.1 |
| 4,251,969 | A | * | 2/1981 | Bains | 52/584.1 |
| 4,430,838 | A | * | 2/1984 | Bains | 52/584.1 |
| 5,556,079 | A | * | 9/1996 | West | E04H 17/143 256/19 |
| 6,802,168 | B1 | * | 10/2004 | Minnick | 52/592.1 |
| 2008/0127577 | A1 | * | 6/2008 | Elmiger et al. | 52/30 |

FOREIGN PATENT DOCUMENTS

| | | | | | |
|---|---|---|---|---|---|
| EP | 0997424 | A1 | | 5/2000 | |
| FR | 2290595 | A1 | | 6/1976 | |
| FR | 2721074 | A1 | | 12/1995 | |
| IT | EP 1657206 | A2 | * | 5/2006 | B66B 11/0253 |
| JP | 2008120470 | A | * | 5/2008 | |
| JP | 2009263096 | A | * | 11/2009 | |
| JP | 2013249178 | A | * | 12/2013 | |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A connecting element connects a first wall panel with a second wall panel. A first spring element is supported on the upper part of the connecting element and on one side of a first bend. A second spring element is supported on the upper part and on one side of a second bend. The other side of the second bend presses on one side of the first bend. The connecting element is introduced without a tool into a first slot of the first bend and the second bend is placed at a second slot over the connecting element.

6 Claims, 4 Drawing Sheets

EQUIPMENT FOR CONNECTING PANELS OF AN ELEVATOR CAGE

CROSS-REFERENCE TO RELATED APPLICATION

This application claims priority to European Patent Application No. 11154176.9, filed Feb. 11, 2011, which is incorporated herein by reference.

FIELD

The disclosure relates to equipment for connecting panels of an elevator cage.

BACKGROUND

A system for connecting wall slats of an elevator cage has become known from the patent specification EP 0 997 424 B1. A connecting device arranged at a first wall slat consists of a retaining element and a clamping element. A locking opening is provided at a second wall slat and has two circular regions with larger diameters and, between the circular regions, a rectangular region with a smaller width than the larger diameter. The retaining element is fixedly connected with the first wall slat by means of a rivet connection, wherein a rivet head of the cylindrical retaining element presses against the first wall slat. The cylindrical clamping element embraces the cylindrical retaining element and is pushable in the direction of the rivet axis, wherein on the one hand the first wall slat and on the other hand a shoulder of the retaining element limit the displacement travel. Provided between the shoulder and the clamping element is a spring element which presses the clamping element against the first wall slat. The second wall slat is placed at a circular region of the locking opening over the clamping element and moved up to the first wall slat and then moved further along the first wall slat until the rectangular region of the locking opening at the conical end of the clamping element presses the clamping element against the shoulder of the retaining element against the spring force of the spring element.

The retaining element fastened by means of a rivet connection to the wall slat is complicated. A special rivet tool and a minimum width of the panel end face are necessary for production of the rivet connection.

SUMMARY

At least some embodiments of the disclosed technologies comprise connecting equipment by means of which the two wall panels are connectible in simple manner.

In particular embodiments, two wall panels of an elevator cage are connectible without tools. Provided at the end face of each wall panel is a locking opening in the form of a vertically extending slot which has a narrowed region at one end. In the case of the first wall panel the slot is narrower or narrowed at the lower end and in the case of the second wall panel the slot is narrower or narrowed at the upper end. A connecting element is introducible into the slot of the first wall panel and movable along the slot downwardly into the narrowed region. In the narrowed region of the slot the first wall panel reaches into a narrowed region of the connecting element, wherein a first spring of the connecting element presses on the first wall panel and detachably connects the connecting element with the first wall panel. The second wall panel is placed at its slot over the connecting element and moved downwardly along the connecting element. The narrowed region of the slot of the second panel reaches into the narrowed region of the connecting element and up to the first spring of the first connecting element. A second spring of the connecting element presses on the second wall panel and connects this with the connecting element and the first wall panel.

Wall panels with deviations in sheet thickness caused by production tolerances are connectible by the above-mentioned connecting element. The first and second springs provide compensation for the deviations and can provide a firm connection between the wall panels. If a wall panel with a greater sheet thickness is used, the sheet is made thinner, for example by stamping, in the narrowed region of the slot so that the wall panels fit in the narrowed region and under the springs of the connecting element.

A good clamping effect between the wall panels and between the first wall panel and the connecting element and the second waif panel and the connecting element is achieved by the two springs of the connecting element. Moreover, a precise positioning of the second wall panel relative to the first wall panel is possible by the connecting element. The position of the connecting element in vertical direction is predetermined by the lower end of the narrowed region of the slot of the first wall panel. When the connecting element is pushed into the narrowed region the connecting element stands at the lower end of the narrowed region and is thus precisely positioned at the first wall panel. The position of the second wall panel in vertical direction is predetermined by the upper end of the connecting element. When the narrowed panel region is pushed into the narrowed region of the connecting element the second panel element stands against the upper end of the connecting element and is thus precisely positioned opposite the connecting element. However, the second panel element is still movable opposite to its displacement direction for fine positioning.

A connection or several connections between the panels is or are provided over the height of the wall panel. The connecting elements are mounted by hand at the first wall panel by pushing into the slot. The second wall panel is then placed at its slots over the connecting elements and moved downwardly until in abutment with the connecting elements and the multiple connection at the longitudinal sides of the two wall panels is finished. An entire grid of slots can also be provided at the longitudinal sides of the two wall panels, but depending on the respective requirement merely some of them can be furnished with connecting elements.

BRIEF DESCRIPTION OF THE DRAWINGS

The disclosed technologies are explained in more detail by way of exemplifying embodiments with reference to the accompanying figures, in which.

DETAILED DESCRIPTION

Figure 1:
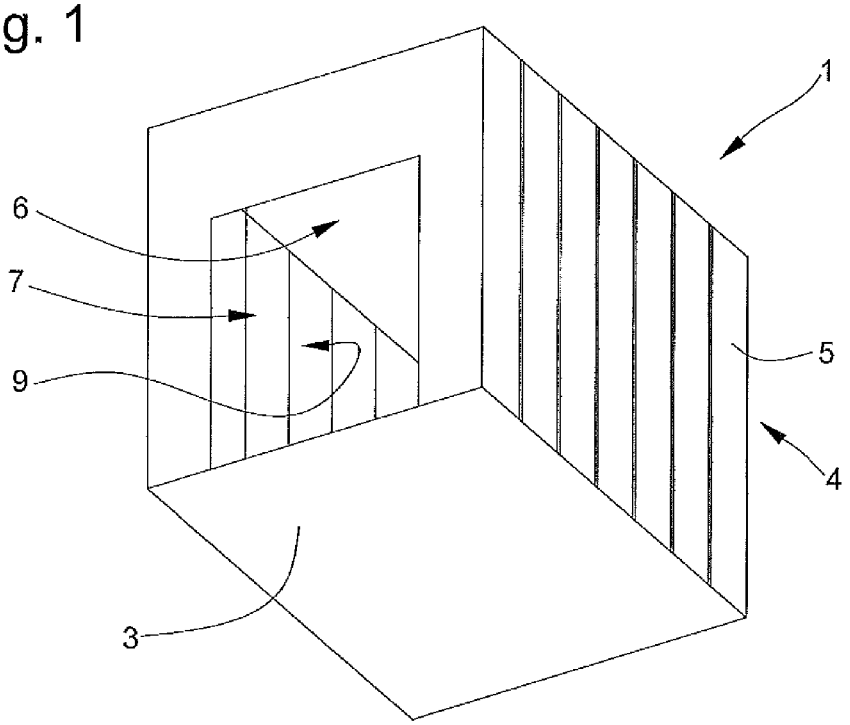
FIG. 1 shows an elevator cage with wall panels.

FIG. 1 shows an elevator cage 1 consisting of a floor frame with floor 3, wall panels 5 forming walls 4, a ceiling 6 and a cage entrance 7. Not illustrated are the entrance doors and the support frame carrying the floor frame 2.

Figure 2:
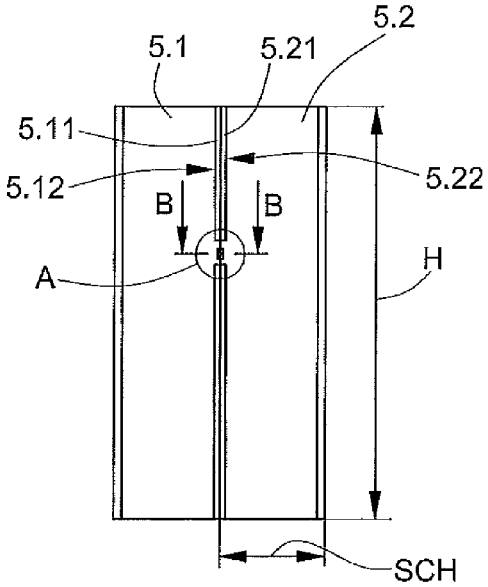
FIG. 2 shows two wall panels of the elevator cage.

FIG. 2 shows a first wall panel 5.1 and a second wall panel 5.2 of the elevator cage 1. The first wall panel 5.1 has a first bend 5.11, which forms a first end face 5.12. The second wall panel 5.2 has a second bend 5.21 which forms a second end face 5.22. The wall panels 5.1, 5.2 are connected at the narrow side SCH thereof with the floor frame 2 and interconnected along the panel height H at least once at the end faces 5.12, 5.22. A detail denoted by A is explained in more detail in FIGS. 3 to 5.

Figure 3:
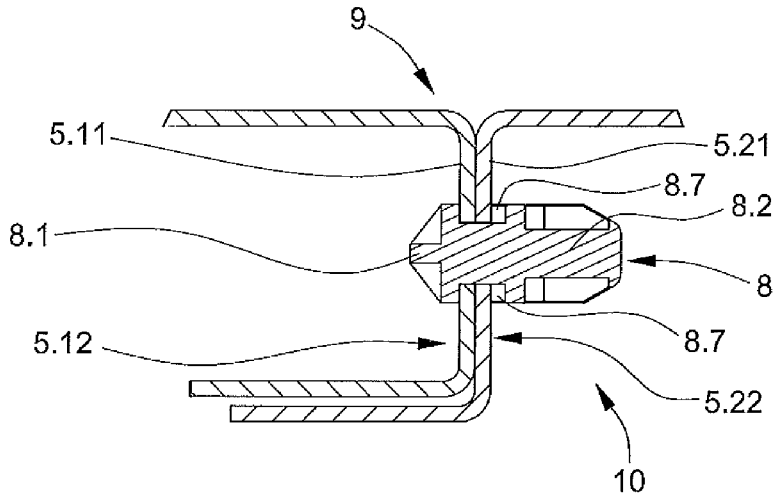
FIG. 3 shows a horizontal section along the line B-B of FIG. 2.

FIG. 3 shows a horizontal section along the line B-B of FIG. 2. The first bend 5.11 of the first wall panel 5.1 forms the first end face 5.12 of the first wall panel 5.1. The second bend 5.21 of the second wall panel 5.2 forms the second end face 5.22 of the second wall panel 5.2. The first wall panel 5.1 is connected with the second wall panel 5.2 by means of a connecting element 8, wherein the first bend 5.11 and the second bend 5.21 lie one on the other. The wall panels 5.1, 5.2 interconnected at the end face form a flat surface on a passenger side 9 of the elevator cage 1, wherein the two bends 5.11, 5.21 and the connecting element 8 are arranged on an outer side 10 of the elevator cage 1.

The example shown in FIG. 3 of a connecting element 8 is of integral construction and is produced from, for example, plastics material by means of an injection-molding process. Details of the integral connecting element 8 are illustrated in FIG. 5. The basic functioning of the connecting element 8 is explained in FIG. 4 and FIG. 6 to FIG. 9 on the basis of a multi-part connecting element 8.

Figure 4:
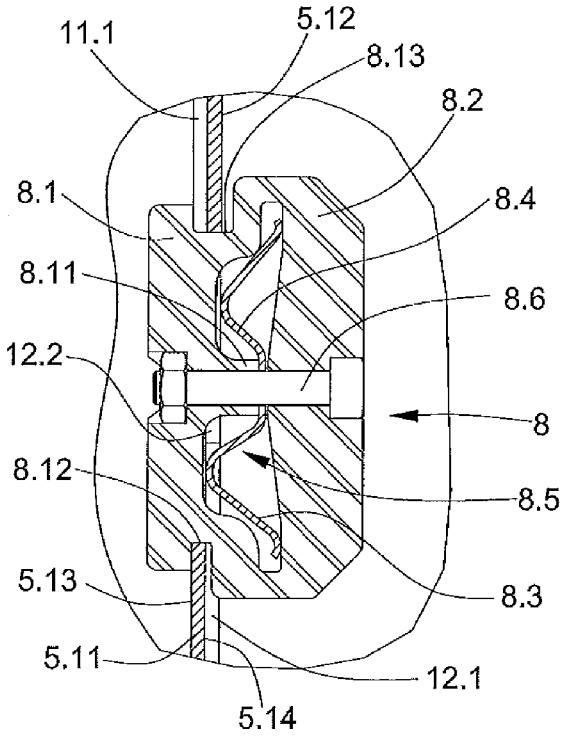
FIG. 4 shows a detail A of FIG. 2 of the wall panels connected by means of connecting element.

FIG. 4 shows the detail A of FIG. 2, wherein the multi-part connecting element 8 connecting the wall panels 5.1, 5.2 is sectioned in vertical direction, and wherein the connecting element 8 consists of a connecting body, a spring element and a screw. The connecting element 8 consists of a foot 8.1 and an upper part 8.2. The foot 8.1 and upper part 8.2 form an integral connecting body, wherein the foot 8.1 has a boss 8.11 directed towards the upper part. A first spring element 8.3 and a second spring element 8.4 form an integral spring body 8.5, which is pressed centrally by means of the boss 8.11 and by means of a screw 8.6 against the upper part 8.2. The spring body 8.5 is produced from, for example, a spring steel plate. The first spring element 8.3 is supported on the upper part 8.2 and on one side of the first bend 5.11. The foot 8.1 serves as a counter-bearing and is supported on the other side of the bend 5.11. The second spring element 8.4 is supported on the upper part 8.2 and on one side of the second bend 5.21. The other side of the second bend 5.21 presses on the one side of the first bend 5.11.

Figure 5A:
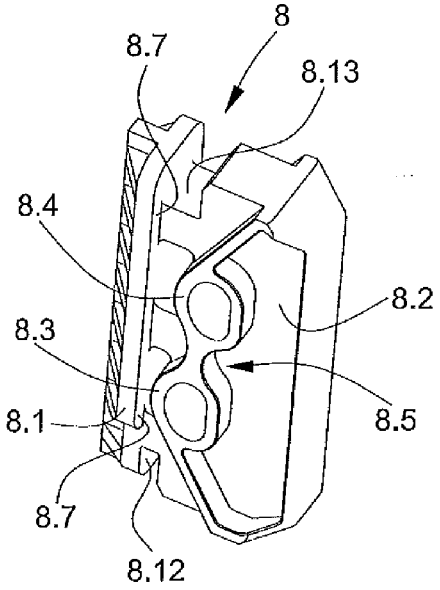
FIG. 5 and FIG. 5*a* show variants of embodiment of a connecting element.
Figure 5:
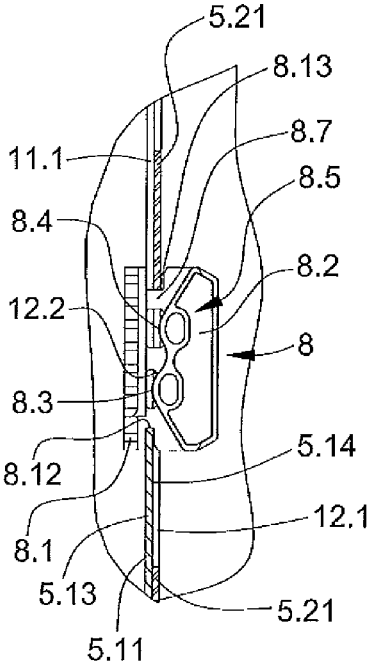

FIG. 5 and FIG. 5*a* show a variant of embodiment of an integral connecting element 8 for connecting the first wall panel 5.1 with the second wall panel 5.2. In distinction from the connecting element 8 of FIG. 4, the connecting element 8 of FIGS. 5, 5*a* is made from a casting and is produced, for example, from plastics material by means of an injection-molding process. The integral connecting element 8 has a low weight and can be mass-produced economically. The first spring element 8.3 and the second spring element 8.4 form the spring body 8.5, which is part of the upper part 8.2 and exercises the same function as the spring body 8.5 of FIG. 4.

FIGS. 6 to 9 show the assembly of the multi-part connecting element 8 for connecting the first wall panel 5.1 with the second wall panel 5.2. The assembly of the integral connecting element 8 can be substantially identical with the assembly of the multi-part connecting element 8.

Figure 6:
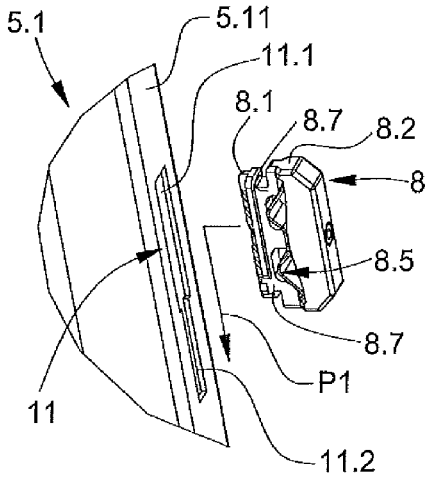
FIG. 6 to FIG. 9 show an assembly of the connecting element for connecting the wall panels.

FIG. 6 shows the first wall panel 5.1 with a first slot 11 at the first bend 5.11. The first slot 11 has a wide region 11.1 and a narrow or narrowed region 11.2. The narrow slot 11.2 is directed downwardly. The foot 8.1 of the connecting element 8 is less wide than the wide region of 11.1 of the first slot 11 and wider than the narrow region 11.2 of the first slot 11. A first arrow P1 symbolizes the movement for tool-free assembly of the connecting element 8 at the first bend 5.11 of the first wall panel 5.1. The connecting element 8 is handled purely manually for the assembly, wherein the upper part 8.2 of the connecting element 8 serves as assembly grip, which is held, for example, by means of thumb and index finger. The foot 8.1 of the connecting element 8 is introduced up to a narrowed region 8.7 of the upper part 8.2 by a horizontal movement in the wide region 11.1 of the slot. Thereafter, the connecting element 8 at the narrowed region 8.7 of the upper part 8.2 is introduced by a downward vertical movement into the narrow region 11.2 of the first slot 11, wherein the foot 8.1 slides at a rear side 5.13 of the first bend 5.11 and the first spring element 8.3 presses on a front side 5.14 of the first bend 5.1 at both sides of the first slot 11. The pushing-in of the connecting element 8 is continued until the narrowed region 8.7 of the upper part 8.2 stands against a first abutment 8.12 at the end of the narrow region 11.2 of the first slot 11 at the first bend 5.11.

Figure 7:
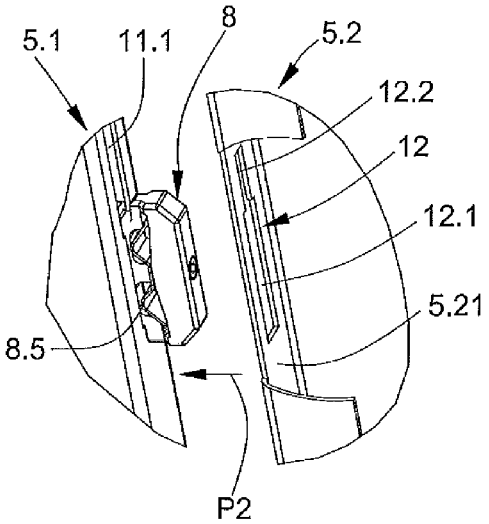

FIG. 7 shows how the second bend 5.21 of the second wall panel 5.2 is placed over the connecting element 8. A second slot 12 with a wide region 12.1 and a narrow or narrowed region 12.2 is provided at the second bend 5.21 of the second wall panel 5.2, wherein the narrow region 12.2 of the second slot 12 is directed upwardly. A second arrow P2 symbolizes the movement for placing the second bend 5.12 over the connecting element 8.

Figure 8:
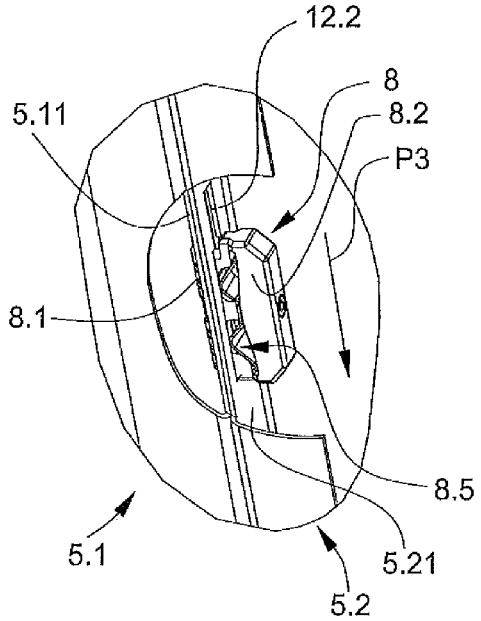

FIG. 8 shows the second bend 5.21 placed over the connecting element 8. The first bend 5.11 and the second bend 5.21 now lie tightly against one another. A third arrow P3 symbolizes the movement for connecting the second bend 5.21 with the connecting element 8. With the vertical movement P3, the narrow region 12.2 of the second slot 12 displaces over the narrowed region 8.7 of the upper part 8.2 until the upper end of the narrow region 12.2 of the second slot 12 stands against a second abutment 8.13 of the narrowed region 8.7 of the connecting element 8. In this position the narrow region 12.2 of the second slot 12 reaches to in front of the first spring element 8.3 as shown in FIGS. 4 and 5. The second spring element 8.4 is supported on the upper part 8.2 and on one side of the second bend 5.21. The other side of the second bend 5.21 presses on the one side of the first bend 5.11.

Figure 9:
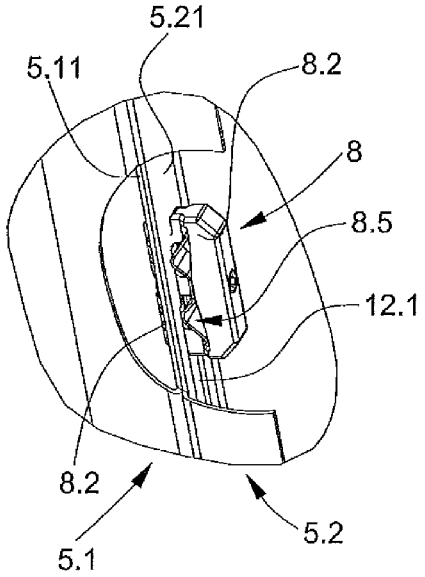

FIG. 9 shows the finished connection between the first bend 5.11 and the second bend 5.21. The connecting element 8 is neither visible nor accessible from the passenger side 9. There is no risk of injury emanating from the connecting element for the cage passengers. With the concealed arrangement of the connecting element 8 no cause is given for vandalism.

Figure 10:
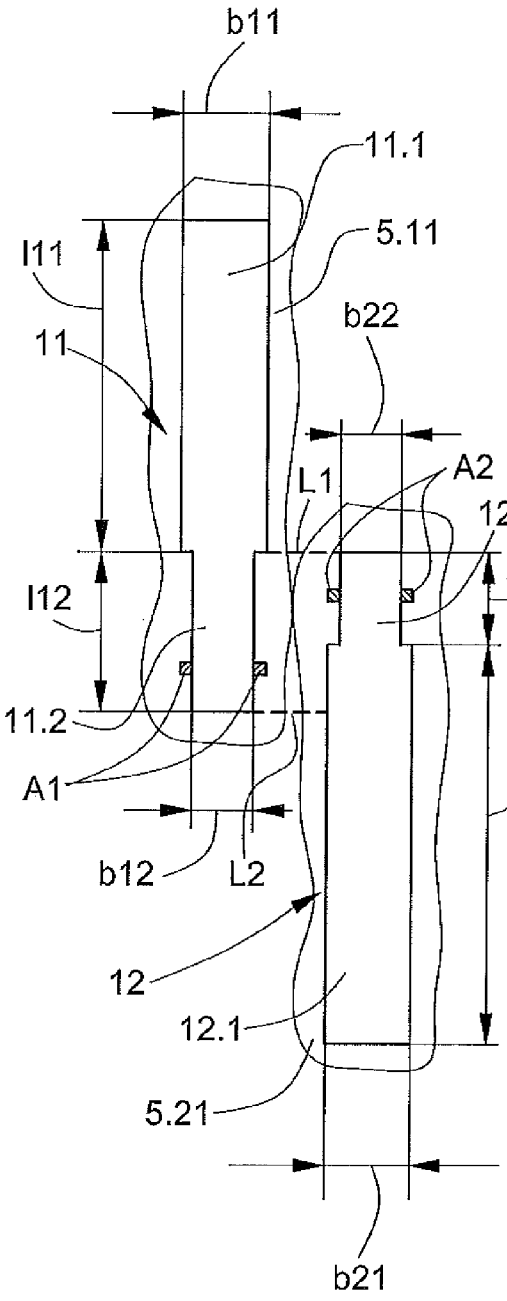
FIG. 10 shows details of the connection of wall panels.

FIG. 10 shows how the first slot 11 and the second slot 12 lie one above the other in the finished connection according to FIG. 9. For clearer illustration, the slots 11, 12 are shown pushed apart along the lines L1, L2. Moreover, FIG. 10 shows a first support surface A1 or a first contact zone of the first spring element 8.3 at the first bend 5.11 and a second contact surface A2 or a second contact zone of the second spring element 8.4 at the second bend 5.21. The first spring element 8.3 reaches through the wide region 12.1 of the second slot 12 and presses, in the case of the first support surface A1, on the first bend 5.11. The second spring element 8.4 presses, in the case of the second support surface A2, on the second bend 5.21.

The first slot 11 and the second slot 12 are dimensioned in FIG. 10. The dimensions can change depending on the respective loading and sheet thickness of the wall panels 5.1, 5.2. In an exemplifying embodiment the following dimensions are given: 111=40 mm, 112=25 mm, b11=8 mm, b12=5 mm, 121=40 mm, 122=15 mm, b21=8 mm and b22=5 mm. In some embodiments, the upper part 8.2 of the connecting element 8 is a few tenths of a millimeter narrower than b11 or b21. The narrowed region 8.7 of the connecting element 8 is a few tenths of a millimeter narrower than b12 or b22. The narrowed region 8.7 reaches from the first abutment 8.12 up to the second abutment 8.13 and corresponds with approximately 112.

Figure 11:
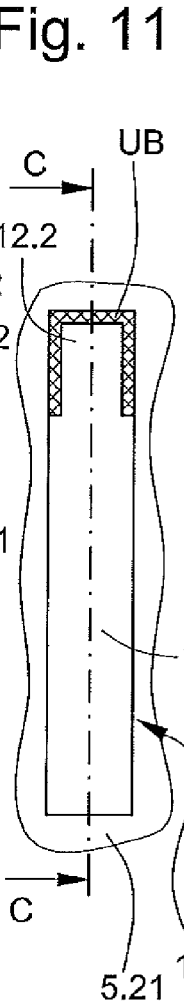
FIG. 11 and FIG. 12 show a connection with a wall panel with excess thickness.
Figure 12:
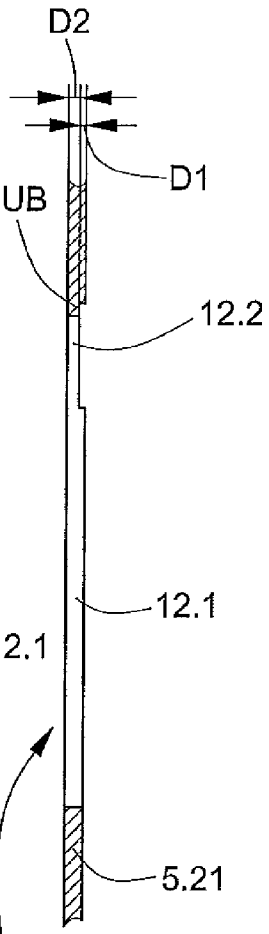

The spring body 8.5 is designed for a specific material thickness of the wall panels 5.1, 5.2. A specific spring body 8.5 matches wall panels 5.1, 5.2 with a specific sheet thickness, for example 1.25 mm. A too-small sheet thickness or a too-large sheet thickness loads the spring elements 8.3, 8.4 too little or too much. FIGS. 11 and 12 show how a wall panel with an excessive wall thickness is connectible. The second wall panel 5.2 has, for example, a wall thickness which is too large by the thickness D1. In order that the second spring element 8.4 correctly functions notwithstanding the excessive wall thickness of the second bend 5.21, the second bend 5.21 is made thinner by the thickness D1 around the narrow region 12.2 of the second slot 12, for example by stamping, hammering or milling and then has a thickness of D2. The processed bend region is denoted by UB. FIG. 12 shows the thicknesses D1, D2 and is a section along the line C-C of FIG. 11.

The above-explained connection for wall panels can also be used for ceiling panels or floor panels of the elevator cage.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator cage component, comprising:

a first elevator cage panel, the first elevator cage panel comprising a first slot;

a connecting element, the connecting element comprising an integral spring body having a first spring element and a second spring element, the connecting element being insertable into the first slot such that the first spring element presses on the first elevator cage panel, the connecting element further being insertable into the first slot by manual assembly; and a second elevator cage panel, the second elevator cage panel comprising a second slot, the second slot being configured to receive the connecting element such that the second spring element presses on the second elevator cage panel wherein the first spring element extends through the second slot, wherein the first elevator cage panel includes an end face having a first bend, the first slot being arranged at the first bend, the first slot having a first wide region and a first narrow region, and the second elevator cage panel includes an end face having a second bend, the second slot being arranged at the second bend, the second slot having a second wide region and a second narrow region, and the second bend having a reduced thickness near the second narrow region.

2. The elevator cage component of claim 1, the first wide region and the second wide region each being wider than the connecting element, the connecting element comprising a narrow region, the first narrow region and the second narrow region each being configured to receive the narrow region of the connecting element.

3. The elevator cage component of claim 1, the first spring element being wider than the first narrow region and the second spring element being narrower than the second narrow region.

4. The elevator cage component of claim 1, the connecting element comprising an upper part for pushing the connecting element into the first slot.

5. An elevator cage component assembly method, comprising:

providing a connecting component comprising an integral spring body having a first spring element and a second spring element;

inserting the connecting component into a wide region of a first slot of a first elevator cage panel such that the first spring element of the connecting element presses on a first bend of the first elevator cage panel;

pushing a narrowed region of the connecting component in a first direction from the wide region of the first slot into a narrow region of the first slot;

inserting the connecting component into a wide region of a second slot at a second bend of a second elevator cage panel; and displacing the connecting component in the first direction from the wide region of the second slot into a narrow region of the second slot such that the second spring element of the connecting element presses on the second bend of the second elevator cage panel wherein the first spring element extends through the second slot thereby coupling the first cage panel to the second cage panel.

6. An elevator installation comprising:

an elevator cage, the elevator cage comprising, a first elevator cage panel, the first elevator cage panel comprising a first slot including a narrow region opening into a wide region, a connecting element, the connecting element comprising an integral spring body having a first spring element and a second spring element, the connecting element being insertable into the wide region of the first slot and then slidably displaced into the narrow region of the first slot such that the first spring element presses on the first elevator cage panel, the connecting element further being insertable into the first slot by manual assembly, and a second elevator cage panel, the second elevator cage panel comprising a second slot including a narrow region opening into a wide region, the second slot oppositely directed with respect to the first slot, the second slot being configured to receive the connecting element into the wide region of the second slot and then by sliding displacement into the narrow region of the second slot such that the second spring element presses on the second elevator cage panel and the first spring element extends through the second slot.

* * * * *